United States Patent [19]

Loucks

[11] 4,371,830

[45] Feb. 1, 1983

[54] HIGH VOLTAGE CHARGE-REGULATING POWER SUPPLY FOR A PULSED LOAD

[75] Inventor: Richard S. Loucks, Northridge, Calif.

[73] Assignee: International Telephone and Telegraph Corporation, New York, N.Y.

[21] Appl. No.: 265,958

[22] Filed: May 21, 1981

[51] Int. Cl.[3] ..... G05F 1/44

[52] U.S. Cl. ..... 323/265; 315/3.5; 328/176

[58] Field of Search ..... 315/3.5; 323/223, 265, 323/268, 286; 328/53-55, 58, 66, 67, 78, 176

[56] References Cited

U.S. PATENT DOCUMENTS

| | | | |
|---|---|---|---|
| 3,723,798 | 3/1973 | O'Brien | 315/3.5 |
| 4,150,307 | 4/1979 | Loucks | 328/67 X |
| 4,153,871 | 5/1979 | Loucks | 323/268 |

*Primary Examiner*—William M. Shoop
*Attorney, Agent, or Firm*—William T. O'Neil

[57] ABSTRACT

A regulated power supply for high voltage pulsed loads. An AC main or inverter circuit feeds the primary of a transformer which has a tapped secondary. The full secondary voltage is rectified through a diode to charge a main capacitor through a ground-end, low-voltage solid state control circuit. A sensing circuit detects the desired level of main capacitor charge and controls the solid state conductive element into current cutoff, by injecting a voltage step which holds off further main capacitor charging until the next load current pulse. The solid state circuits control operate at low level (ground-end of the high voltage main capacitor) and residual power supply energy is automatically shunted to an unregulated tapped output.

8 Claims, 2 Drawing Figures

HIGH VOLTAGE CHARGE-REGULATING POWER SUPPLY FOR A PULSED LOAD

BACKGROUND OF THE INVENTION

1. Field of the Invention

The invention relates to high voltage regulated direct current power supplies generally and more particularly to such power supplies for use with pulsed loads.

2. Description of the Prior Art

In the prior art there have been many approaches to the problem of voltage regulation for electronic equipment. These prior art art approaches include series and shunt regulators, switching-type regulators and others.

Voltage regulation at very high voltages (tens of thousands of volts) is particularly difficult to accomplish economically in series or shunt circuits, because of the high voltages themselves and because of the power waste frequently associated therewith. Switching-type regulators generally speaking offer the most economical approaches and are particularly adaptable for pulse electronic equipment which operates over a relatively short duty cycle and draws little or no load current between pulses. The radio frequency power amplifiers of modern radar systems employing traveling wave tubes or similar devices, fall into that general load category.

A relatively recent device of the general character, i.e., a high voltage low-duty cycle power supply, was described in U.S. Pat. No. 4,153,871. That disclosure outlines the prior art situation in somewhat more detail, and the comments therein are applicable to the prior art situation as related to the invention herein described.

The device of U.S. Pat. No. 4,153,871 is described as a boot-strap regulator and involves power supply filter capacitor charge current sensing and integration for controlling the so-called "boot-strap" voltage applied across a small capacitor in series at the ground end of the main power supply filter capacitor. Thus, low voltage control circuitry may be employed.

The regulator described in the aforementioned U.S. Pat. No. 4,153,871, although successful, is somewhat more complex than is desirable from an economic point of view. Moreover, that prior art device operates its switching functions synchronously with the RF pulse processed by or through the apparatus which it powers, whereas it is desirable that the power supply for a traveling wave tube or the like be self synchronous in its switching operations and not dependent upon system triggering.

In a radar system employing a traveling wave tube, a high negative cathode voltage is required. In a typical implementation of the present invention, a TWT cathode voltage of 45,000 volts was required. The phase stability of the traveling wave tube is related to this cathode voltage; and in MTI systems or other signal processing systems, the repeatability and stability of the initial TWT cathode voltage at the beginning of a transmitting pulse are the important considerations, it being relatively less important that the high negative cathode voltage remain undiminished during the power pulse, provided the variation of that voltage is accurately repeatable and begins from substantially the same initial voltage.

The particular manner in which the invention provides an effective yet very economical configuration for regulating a direct current, very high voltage for the type of load described will be evident as this description proceeds.

SUMMARY OF THE INVENTION

The device according to the invention requires direct measurement of the high voltage across the power supply filter capacitor. This may be readily accomplished with the advent of various forms of isolated signal coupler operable across large voltage differentials. U.S. Pat. No. 4,032,843 describes such a device, in which an optical fiber link provides the high voltage insulation required.

Circuit of the invention disclosed involves the use of a current source which may be an inverter or the regular AC mains. A transformer having a primary is fed directly from this current source. The secondary of the transformer connects from ground to rectifier diode at its highest voltage terminal and has an intermediate tap. A main high voltage filter capacitor connects from the rectifier diode output to ground through a current shunt diode and a parallel charging current circuit. The current shunt diode is polarized to pass current upon main filter capacitor discharge during load pulsing, however, the charging control circuit which includes the emitter-collector path of a transistor carrys the charging current. A zener diode in parallel with the transistor emitter-collector current path assumes a step or pedestal voltage when the current control transistor is blocked by a signal from the high voltage threshold sensing circuit. The zener diode voltage essentially lifts the main filter capacitor by its voltage further operating to prevent additional charging of the main filter capacitor.

A secondary filter capacitor connects from the transformer tap to the rectifier diode output terminal and provides a fraction of the overall main filter capacitor voltage as a traveling wave tube collector voltage. The main filter capacitor high voltage provides the negative cathode high voltage supply required by the traveling wave tube.

The details of a circuit according to the invention will be described hereinafter with reference to the drawings and from that description the efficient and simplified nature of the circuit will become evident.

DETAILED DESCRIPTION OF THE DRAWINGS

Figure 1:
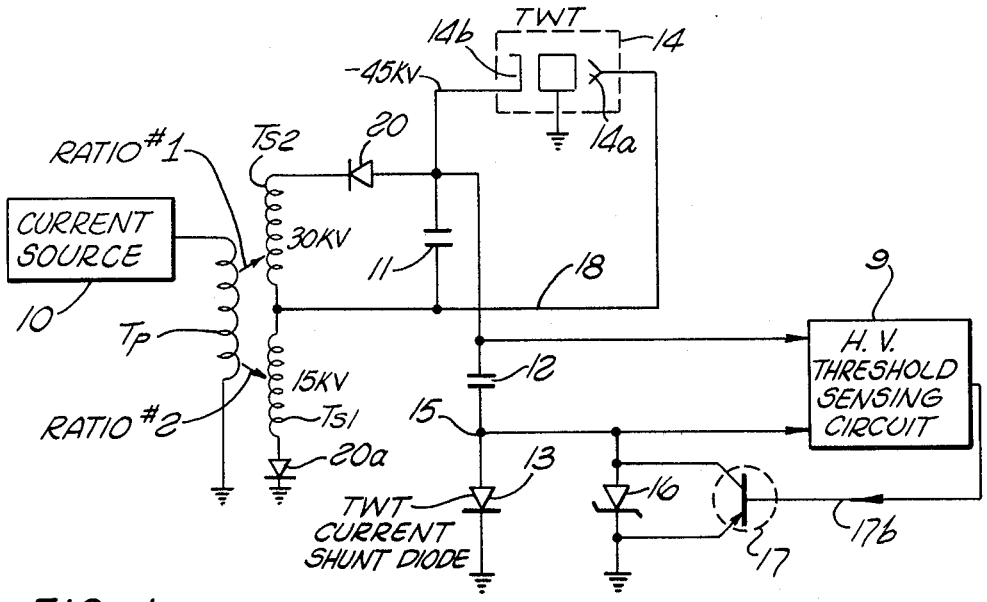
FIG. 1 is a schematic of a typical implementation of a high voltage charge-regulating power supply for a pulse load according to the invention.

Referring now to FIG. 1, a typical circuit for the practice of the invention is illustrated. A traveling wave tube microwave amplifier is illustrated generally at 14, this device having a cathode **14*b* intended for operation at a high negative voltage, for example, negative 45 KV. A collector electrode 14*a* is intended to be operated at a negative voltage of lesser magnitude. These negative voltages are extant with respect to the grounded body element 14*c***.

The radio frequency input and output connections for traveling wave tube 14 are omitted, however it is to be understood that they are conventional and would be provided in an operative system.

As previously indicated, power supplies of the charge regulating type such as the present combination are adapted to the pulsed load current application in which the load current between pulses is negligible. Accordingly, an elaborate ripple filter is normally not required in such a system .

The current source 10 may be of the so-called inverter type or may actually be the alterating current main supply, in any event, it feeds the primary $T_p$ of a transformer. The secondaries $T_{s1}$ and $T_{s2}$ provide 15 KV and 30 KV of AC, respectively. The transformer ratios No. 2 and No. 1 being (typically) 1-to-50 and 1-to-100 correspondingly, where the primary source from 10 is on the order of 300 volts.

It will be seen that a main filter capacitor 12 will be charged to a high negative voltage through diodes 20 and 20*a*, the full voltage of both transformer secondaries being effective in producing this charge. The ground side of the capacitor 12 at junction 15 is essentially clamped to ground during the charging time through the emitter-collector circuit path of transistor 17. The base 17*b* of transistor 17 is held at a level (by the output signal of the high voltage threshold sensing circuit 19) to keep the transistor 17 conducting in saturation during that time. Diode 13 is oppositely polarized in respect to the charging current into capacitor 12 and therefore does not conduct during that time. The capacitor 11 acts to charge to a voltage which is approximately a two-third fraction of that to which capacitor 12 is charged, the lead 18 thus supplying this lesser negative, but unregulated, voltage to the travelling wave tube collector electrode 14*a*. As previously indicated, the requirement for stability and repeatability of the travelling wave tube cathode 14*b* supply stems from the phase instability of the traveling wave tube caused by variations at 14*b*. That instability is significantly disadvantageous in moving target indicator radars of one type or another. The voltage at the travelling wave tube collector 14*a* is not critical in that regard.

The high voltage threshold sensing circuit 19 is essentially a circuit of conventional type for monitoring the instantaneous voltage across the capacitor 12 and for generating a signal at transistor base 17*b* which keeps transistor 17 in saturation whenever the terminal voltage across capacitor 12 is below a predetermined value (in the example case −45 KV). Once capacitor 12 has been charged to this predetermined voltage, however, circuit 19 acts to cut off transistor 17 by appropriately biasing its base 17*b*. The nature of the circuits of block 19 are entirely conventional and will be obvious to those of skill in the electronic arts once the requirement for its operation is set forth as hereabove.

Figure 2:
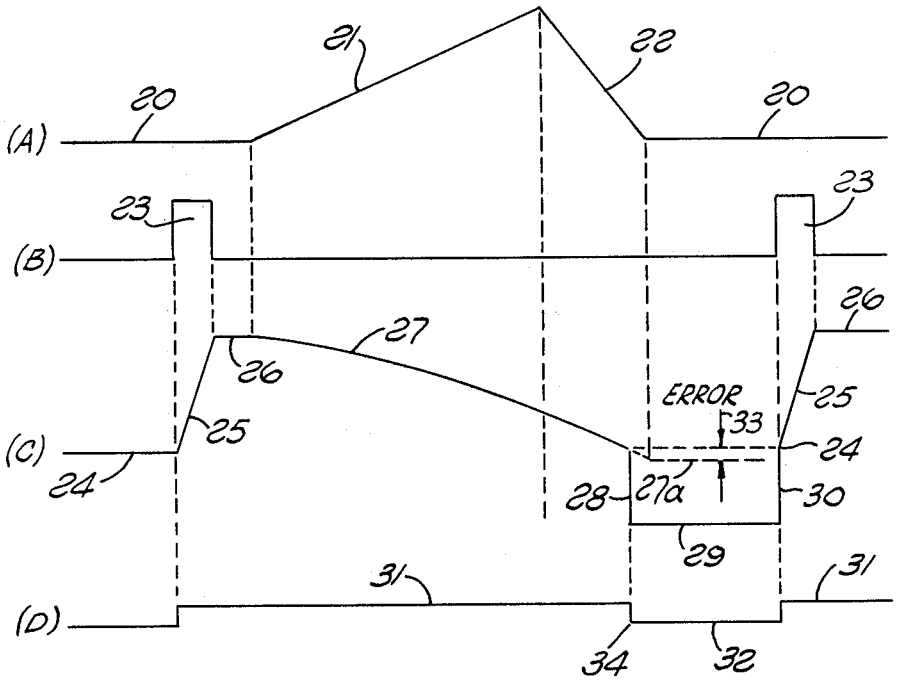
FIG. 2 depicts selected waveforms from various points in the circuit of FIG. 1.

Referring now to FIG. 2 to continue the explanation of FIG. 1, it is useful to associate the operational waveforms with the description. FIG. 2(*d*) identifies transistor 17 condition including a portion 31 during which transistor 17 is conducting in saturation and a portion 32 in which it is cut off. The point at which transistor 17 disconnects (changes from the 31 to the 32 condition) when capacitor 12 has reached its predetermined level of charge (voltage), is depicted at 34 on FIG. 1(D). The corresponding voltage level 24 on FIG. 1(C) which is capacitor 12 voltage continues until the next radio frequency pulse 23 depicted in FIG. 2(B) arrives, since the charging function is essentially terminated with the cut off of transistor 17 and the application of the pedestal step 28, 29 and 30 as depicted in FIG. 2(C).

This pedestal step occurs at and lasts throughout the time of cut off 32 on FIG. 2(D), of transistor 17 at which time zener diode 16 (previously shorted out by the emitter-collector circuit of transistor 17, now exhibits its zener voltage, typically 200 volts. That 200 volt step or pedestal will be seen to "jack-up" the lower end of capacitor 12 and therefore add the same step voltage (with respect to ground) to its upper end (junction of diode 20 and capacitor 11) without changing the voltage across the actual terminals of capacitor 12. Rectifier diode 20 is therefore at least partially back biased during the time of this pedestal, and also the charging path for capacitor 12 through the emitter-collector circuit of transistor 17 is contemporaneously interrupted.

In the absence of the clamping of the voltage across capacitor 12 by the aforementioned action, the charging curve 27 of FIG. 2(C) would be expected to continue at 27*a* in the negative direction producing an error identifed as 33.

The pulsing of the traveling wave tube 14 or the other device utilizing the power supply configuration of the invention depicted at 23 on FIG. 2(B) immediately begins the discharge of capacitor 12. This discharge is represented at curve 25 on FIG. 2(C). The initial increment of decrease in the nominal maximum voltage in capacitor 12 is sensed by circuit 19 with the result that transistor 17 is again conductive. And the pedestal produced by zener diode 16 promptly disappears with the result that the voltage level 24 of FIG. 2(C) is reached immediately before the more actual discharge depicted at 25 begins.

Once the pulse 23 of FIG. 2(B) passes, the voltage at the high end of capacitor 12 stabilizes in a region 26 on FIG. 2(C) during which time the circuit is quiescent until the charging waveform 21/22 begins. It will be noted that during discharge of capacitor 12 during the TWT pulse 23, current is conducted through the TWT cathode 14*b* and body 14*c* through the shunt diode 13. Additionally, current is conducted via the collector 14*a* back to the transformer tap via lead 18 and thence through transformer secondary $T_{S1}$. At the end of the TWT pulse 23, the circuit again enters quiescence until the next electrical event occurs.

FIG.1(A) shows the current waveform in the transformer primary $T_p$ in time relationship with the events of FIGS. 2(B) through (D). For illustration, a triangular waveform is shown at 21 and 22. The circuit, however, is equally applicable to other power waveforms such as sinusoidal inputs or the like.

Various modifications of the specific implementations will suggest themselves to those of skill in this art once the principles of the invention are understood. The previously mentioned optical fiber link high voltage measurement technique of U.S. Pat. No. 4,032,843 is of particular interest for circuit 19, although the relatively low voltage at reference point 15 facilitates more conventional high voltage analog techniques without significant difficulty.

What is claimed is:

1. A high voltage dc power supply for a load which draws current during recurrent pulse times and substantially no current between pulses, comprising:

a first capacitor, a source of current at high voltage and a first diode connected between said capacitor and said source to provide charging of said capacitor;

a ground potential return circuit between said source and said first capacitor and a second diode connected in series in said return circuit, said second diode being polarized so as to pass current during discharge but not during charging of said capacitor, the grounded terminal of said second diode and the junction of said first diode and said capacitor providing the terminals for connecting said load;

a high voltage threshold sensing circuit connected to measure the voltage across said capacitor and to generate a switching signal in a first condition when said capacitor charges to a predetermined voltage and in a second condition whenever said capacitor voltage has an absolute value less than said predetermined voltage; and control means responsive to said switching signal and connected in parallel with said second diode for clamping the junction of said capacitor and said second diode to ground during said switching signal second condition and for providing a voltage pedestal at said capacitor and second diode junction during said first switching signal condition.

2. Apparatus according to claim 1 in which said control means comprises a zener diode connected in parallel with said second diode and like poled, said zener diode having a zener voltage equal to said voltage pedestal effective during said first switching signal condition.

3. Apparatus according to claim 1 in which said source of current at high voltage is defined as an AC source having DC continuity.

4. Apparatus according to claim 3 in which said source comprises a transformer having a primary winding and a tapped secondary winding and in which a second capacitor is provided connected from said junction of said first capacitor and first diode to said secondary winding tap thereby to provide an unregulated second source of power across the terminals of said second capacitor.

5. Apparatus according to claim 1 in which said control means comprises a transistor having its emitter-collector path connected in parallel with said second diode and its base electrode connected to be controlled between substantially saturated conduction and substantial non-conduction through said emitter-collector path as a function of said switching signal condition.

6. Apparatus according to claim 2 in which said control means comprises a transistor having its emitter-collector path connected in parallel with said second diode and its base electrode connected to be controlled between substantially saturated conduction and substantial non-conduction through said emitter-collector path as a function of said switching signal condition.

7. Apparatus according to claim 2 in which said source of current at high voltage is defined as an AC source having DC continuity.

8. Apparatus according to claim 7 in which said source comprises a transformer having a primary winding and a tapped secondary winding and in which a second capacitor is provided connected from said junction of said first capacitor and first diode to said secondary winding tap thereby to provide an unregulated second source of power across the terminals of said second capacitor.

* * * * *